US006295976B1

(12) United States Patent
Runde

(10) Patent No.: US 6,295,976 B1
(45) Date of Patent: Oct. 2, 2001

(54) PORTABLE HANGER FOR HUNTING BOW

(76) Inventor: Samuel J. Runde, 3750 Sandy Hook Rd., Hazel Green, WI (US) 53811

( * ) Notice: Subject to any disclaimer, the term of this patent is extended or adjusted under 35 U.S.C. 154(b) by 0 days.

(21) Appl. No.: 09/575,502

(22) Filed: May 19, 2000

(51) Int. Cl.[7] ..... F41B 5/00

(52) U.S. Cl. ..... 124/86; 224/916; 248/217.4; 248/304

(58) Field of Search ..... 124/23.1, 25.5, 124/25.7, 86, 88; 224/916; 248/205.1, 217.4, 218.4, 220.21, 304

(56) References Cited

U.S. PATENT DOCUMENTS

| | | | | |
|---|---|---|---|---|
| 350,209 | * | 10/1886 | Parmelee . | |
| 4,095,768 | * | 6/1978 | Chasen | 248/304 X |
| 4,856,953 | * | 8/1989 | Lin | 248/217.4 X |
| 5,114,107 | * | 5/1992 | Mahn et al. | 248/217.4 |
| 5,207,404 | * | 5/1993 | Reinhard | 248/217.4 |
| 5,292,014 | * | 3/1994 | Lelong | 248/218.4 X |
| 5,482,241 | * | 1/1996 | Oglesby | 248/217.4 X |
| 5,806,508 | * | 9/1998 | Stempien et al. | 124/86 |
| 5,867,475 | * | 10/1999 | Johnson | 248/217.4 |
| 6,059,240 | * | 5/2000 | Gorsuch | 124/86 X |

OTHER PUBLICATIONS

P. 205 from Pape's Archery Catalog 1999 3 items circled.
P. 403 from Cabela's Fall 1999 archery catalog See 4 items circled (but some of these attach to a tree stand—not to tree trunk as Applicant's hanger).

* cited by examiner

*Primary Examiner*—John A. Ricci
(74) *Attorney, Agent, or Firm*—John V. Stewart

(57) ABSTRACT

A hunting bow hanger in the form of a cylindrical shaft of substantially the same length and diameter as a hunting arrow, having self-starting wood screw threads on one end, and a hook that includes a crank portion on the other end. The crank is used to turn the shaft manually to screw the threads into a tree trunk. To prevent bending of the shaft under load, a cable tether is provided that spans from the hook end of the shaft diagonally upward to an anchor higher on the tree trunk. The anchor has self-starting wood screw threads and a crank portion for tool-less threading into the tree trunk. The cable is attached to the hanger shaft near the hook end, and has a free end with a loop that slips over a retention portion of the anchor crank. This provides a sturdy bow hanger that is carried in the quiver in place of one of the arrows.

5 Claims, 2 Drawing Sheets

PORTABLE HANGER FOR HUNTING BOW

BACKGROUND OF THE INVENTION

1. Field of the Invention

This invention relates to portable hanger for hanging a hunting bow on a tree trunk within easy reach of a hunter in a tree platform.

2. Description of Prior Art

Bow hunting from a tree platform involves periods of waiting quietly, and a need to acquire the bow quickly and quietly with minimum movement when ready to shoot. Bow hangers that attach to a tree trunk allow the bow to hang upright near the hunter for quickly reaching the bow with minimum motion. Previous bow hangers must be carried in a pack or strapped to a pack or elsewhere. A simple bow hanger that can be carried in an arrow quiver like an arrow has not been provided.

SUMMARY OF THE INVENTION

The objectives of the present invention are provision of provision of a light-weight, inexpensive bow hanger that can be attached to a tree trunk without tools, is sturdy enough to support the heaviest hunting bow, and can be carried in an arrow quiver in the place of an arrow.

The objectives of the present invention are achieved by a bow hanger in the form of a cylindrical shaft of substantially the same length and diameter as a hunting arrow, having self-starting wood screw threads on one end, and a hook that includes a crank portion on the other end. The crank is used to turn the shaft manually to screw the threads into a tree trunk. To prevent bending of the shaft under load, a cable tether is provided that spans from the hook end of the shaft diagonally upward to an anchor higher on the tree trunk. The anchor has self-starting wood screw threads and a crank portion for toothless threading into the tree trunk. The cable is attached to the hanger shaft near the hook end, and has a free end with a loop that slips over a retention portion of the anchor crank. This provides a sturdy bow hanger.

REFERENCE NUMBERS

Figure 1:
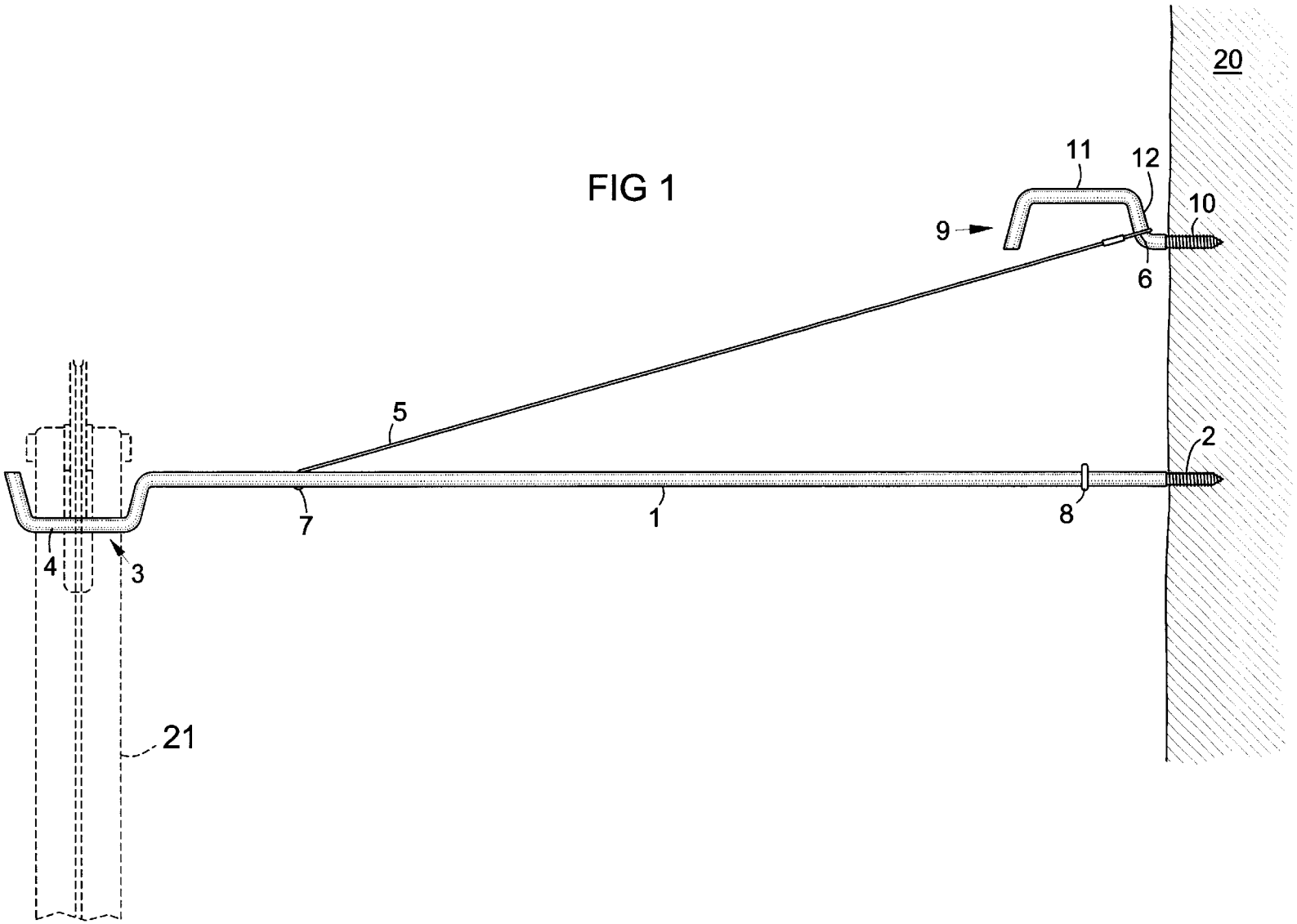
FIG. 1 is a side view of the bow hanger installed on a tree trunk. A hunting bow 21 is hanging on the hook 3. The bow is shown in dashed lines, since it is not part of the invention.
Figure 2:
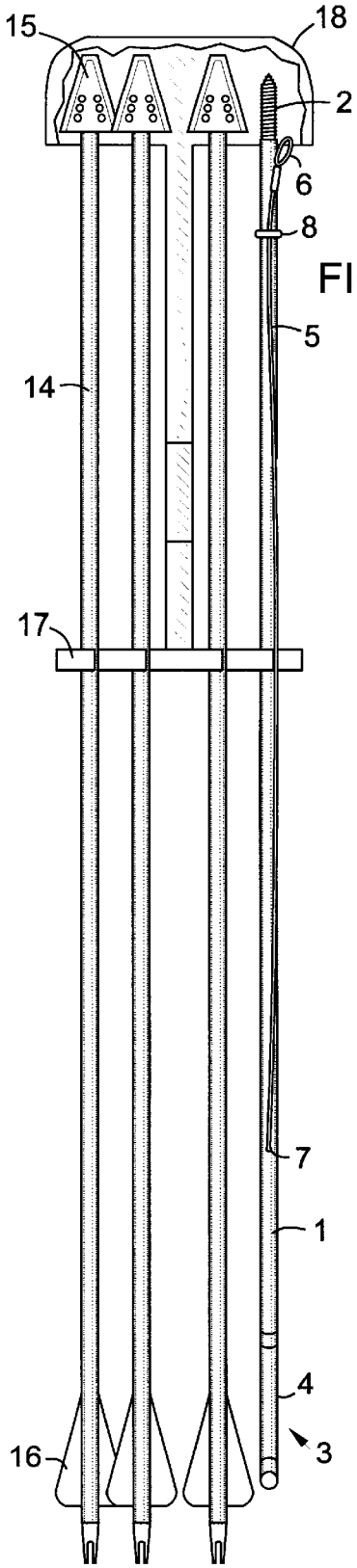
FIG. 2 is a front partial cutaway view of an arrow quiver with 3 arrows, and the bow hanger taking the place of a fourth arrow.
Figure 3:
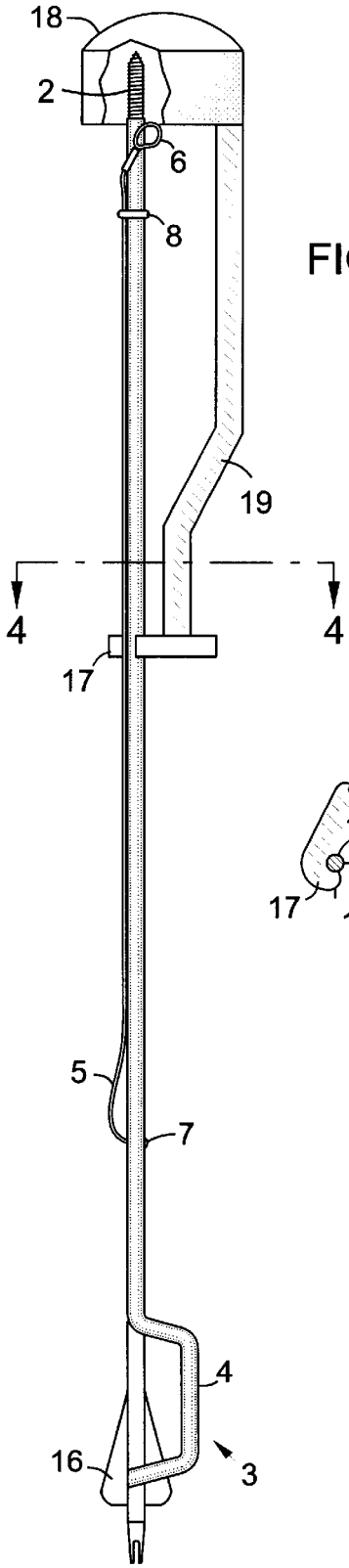
FIG. 3 is a right side partial cutaway view of FIG. 1.
Figure 4:
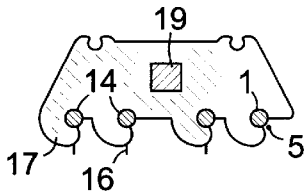
FIG. 4 is a top sectional view along line 4—4 of FIG. 3.
Figure 5:
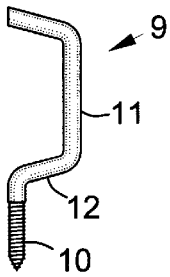
FIG. 5 is a side view of the anchor.

1. Shaft of bow hanger
2. Wood screw threads on shaft
3. Hook of shaft
4. Crank portion of hook on shaft
5. Cable
6. Loop or other connector on free end of cable
7. Attachment of cable to shaft
8. O-ring or clip for holding cable against shaft for storage
9. Anchor
10. Wood screw threads on anchor
11. Crank portion of anchor
12. Cable retainer portion of anchor
13. Arrow quiver

14. Arrow shaft
15. Arrowhead
16. Feather of arrow
17. Retainer of quiver
18. Hood of quiver
19. Spine of quiver
20. Tree trunk
21. Hunting bow

DETAILED DESCRIPTION

FIG. 1 shows a hunting bow hanger according to this invention installed on a tree trunk. The hanger has a shaft 1 with the same nominal diameter and length of a hunting arrow, so it can be stowed in a conventional quiver in place of an arrow. The shaft has a threaded first end 2 with self-starting wood screw threads. The opposite end of the shaft has a hook 3 for hanging a bow. The hook is designed with a crank portion 4 which is offset from the axis of the shaft. This is used to manually twist the shaft to thread the first end into a tree trunk without tools.

Since the shaft of the bow hanger is as slender as an arrow, it needs additional support to hold the weight of a hunting bow. This is provided by a cable tether 5 that spans from near the hook of the shaft diagonally upward to an anchor 9 in the tree trunk at a higher point. This anchor also has self-starting threads 10 and a crank portion 11, which allows it to be threaded into the tree trunk without tools. The anchor may be constructed as shown, or in other equivalent forms such as a wood screw shaft with a T-shaped handle. In any case, a portion of the anchor serves as a retainer for the cable. In the example shown, portion 12 of the anchor crank retains a loop 6 on the end of the cable.

The preferred material of the cable is rubber coated steel cord, although other cable or cord material can be used. The cable is attached to the shaft by any appropriate means. For example, a hole to accept the cable can be drilled through the shaft, and the cable can be threaded through the hole. A metal button 7 larger than the hole can be formed on the end of the cable to stop the cable in the hole. A clip or elastic O-ring 8 is preferably provided near the threaded end of the shaft to hold the cable against the shaft for storage in the quiver.

For installation on a tree trunk, the shaft 1 of the bow hanger is removed from the quiver 17. It is held horizontally, and screwed into the trunk, using the crank portion 4 to manually turn the shaft while pushing the treaded tip 2 against the trunk. Likewise, the anchor 9 is screwed into the trunk above the shaft. The free end 6 of the cable is connected to the anchor, causing the cable to span between the anchor and the extended end of the shaft. Now the shaft is supported by the cable, and a bow can be hung on the hook of the shaft within easy reach of a hunter.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A hunting bow hanger comprising:

a shaft having an axis and first and second ends;

self-starting wood screw threads on the first end of the shaft, the screw threads coaxial with the axis of the shaft;

a hook on the second end of the shaft, the hook having a crank portion that is offset from the axis of the shaft;

a cable having two ends;

the first end of the cable attached to the shaft adjacent the hook;

a cable anchor having a screw portion and a crank portion;

the screw portion of the anchor having an axis and self-starting wood screw threads;

the crank portion of the anchor having a crank or handle that is offset from the axis of the screw portion; and means for connecting the second end of the cable to the anchor;

whereby the shaft and anchor can be manually screwed horizontally into a tree trunk, with the anchor above the shaft, and the second end of the cable can be connected to the anchor, supporting the hook end of the shaft for holding a hunting bow.

2. The hunting bow hanger of claim 1, in combination with a quiver with a plurality of arrow retainers, an arrow mounted releasably in a first one of the retainers, the arrow having a particular diameter and a particular length, the shaft of the bow hanger having substantially the same diameter as the arrow, and the length of the shaft, including the threads and the hook on the shaft, being approximately the same length as the arrow, the shaft of the bow hanger mounted releasably in a second one of the retainers; whereby the shaft of the bow hanger can be carried in the quiver.

3. The hunting bow hanger of claim 1 wherein the shaft has a diameter of 7.9 mm (5/16 inch) plus or minus 1 mm, and the shaft, including the threads and hook on the shaft has an overall length of 68 cm (26.75 inches) plus or minus 5 cm.

4. The hunting bow hanger of claim 1, wherein the second end of the cable has a loop for releasable connection of the second end of the cable to the anchor by slipping the loop over a portion of the anchor.

5. A method of carrying a hunting bow hanger, comprising:

a) providing an arrow quiver with a plurality of arrow retainers;

b) providing at least one arrow in a first one of the retainers in the quiver, the arrow having a particular diameter and a particular length;

c) providing a bow hanger shaft having substantially the same diameter as said one arrow, the shaft having first and second ends, with self-starting wood screw threads on the first end of the shaft, in line with the shaft, and a hook with a crank portion on the second end of the shaft;

d) placing the bow hanger shaft in a second one of the retainers in the quiver;

e) providing a cable with a first end attached to the bow hanger shaft adjacent the hook, and having a second end; and f) providing an anchor having self-starting wood threads, a crank portion, and a cable retainer portion for attachment to the second end of the cable;

whereby the bow hanger shaft is carried in the arrow quiver in the place of an arrow.

* * * * *